United States Patent [19]

Clark et al.

[11] 4,421,371

[45] Dec. 20, 1983

[54] ELECTRICAL SELF-ALIGNING CONNECTOR

[75] Inventors: Keith H. Clark, Decatur; Donald R. Scott, Athens, both of Ala.

[73] Assignee: The United States of America as represented by the Administrator of the National Aeronautics and Space Administration, Washington, D.C.

[21] Appl. No.: 432,057

[22] Filed: Sep. 30, 1982

Related U.S. Application Data

[63] Continuation of Ser. No. 168,995, Jul. 15, 1980, abandoned.

[51] Int. Cl.[3] ..... H01R 13/12; H01R 13/62

[52] U.S. Cl. ..... 339/64 M; 339/258 RR; 339/262 RR

[58] Field of Search ..... 339/64 R, 64 M, 182 R, 339/183, 258 RR, 262

[56] References Cited

U.S. PATENT DOCUMENTS

| | | | |
|---|---|---|---|
| 3,009,043 | 11/1961 | Goodwin, Jr. et al. | 339/64 R |
| 3,673,545 | 6/1972 | Rundle | 339/64 M |
| 3,855,568 | 12/1974 | Cochrane | 339/262 R |
| 3,951,500 | 4/1976 | Anderson | 339/64 M |
| 4,030,797 | 6/1977 | Nieman | 339/64 M |

FOREIGN PATENT DOCUMENTS

| | | | |
|---|---|---|---|
| 140685 | 4/1903 | Fed. Rep. of Germany | 339/182 R |
| 993883 | 9/1952 | France | 339/182 R |

*Primary Examiner*—Joseph H. McGlynn

*Attorney, Agent, or Firm*—Joseph H. Beumer; John R. Manning; Leon D. Wofford, Jr.

[57] ABSTRACT

A self-aligning electrical connector device is disclosed as including a receptacle component (A) having a conically contoured interior and a plug component (B) having a correspondingly contoured conical body receivable in the receptacle component. The plug component B includes a plurality of spaced conductive ring elements 22 having a mating face (22*a*) and the receptacle component includes a plurality of corresponding spaced conductive ring elements (14) providing mating interface with the mating face of the ring elements of the plug component when connected therewith. Each ring element of the receptacle component includes a plurality of segmented portions, (16*a*), which defect downwardly when the plug component is inserted therein to assert a biasing force against the face of the ring elements of the plug component providing positive electrical contact and connection between the ring elements of the components.

2 Claims, 8 Drawing Figures

ELECTRICAL SELF-ALIGNING CONNECTOR

ORIGIN OF THE INVENTION

The invention described herein was made by employees of the U.S. Government and may be manufactured and used by or for the Government for governmental purposes without the payment of any royalties thereon or therefor.

This is a continuation of application Ser. No. 168,995, filed July 15, 1980, now abandoned.

BACKGROUND OF THE INVENTION

The invention relates to electrical connectors which include a male and female counterpart for quick connections and disconnections. In particular, the invention relates to the use of such connectors with applications to space vehicles such as the orbital servicer vehicle. In such applications, a conventional connector which includes multiple circuits and pin connectors has heretofore been utilized which requires precise alignment in both the rotational and translational directions for reliable connection. However, such precise alignment, even with sophisticated space telemetry, is a difficult and troublesome maneuver in space. Many such maneuvers are necessary, for example, during the exchange and ferrying of modules from an orbiting platform or station by the orbital servicer vehicle.

SUMMARY OF THE INVENTION

It has been found that a reliable self-aligning connector, particularly advantageous for space applications can be had which includes a conical receptacle component and a matching plug component wherein the receptacle component includes annular conductive contact rings having a mating surface which is segmented and angled in such a manner to give a positive spring-loaded contact when mated with the plug component. The components may be mechanically connected to their respective module or vehicle surfaces by means of a particular screw connection which provides a clearance space so that some freedom of movement is allowed in the movement of the component when attached to their respective mechanical surfaces and mated further enhancing the self-aligning aspect of the invention which is of particular importance in the application of the invention to ganged connections.

Accordingly, an important object of the present invention is to provide an electrical connector having more precise self-aligning features.

Still a further object of the invention is to provide an electrical connector having two components which may be precisely aligned and connected together by means of mechanical manipulation such as in the application to orbiting space vehicles.

Still another object of the present invention is to provide a self-aligning electrical connector having a receptacle and plug component wherein mating of the conductive portions is made positively and reliably.

Yet another important object of the present invention is the provision of means for attaching components of a self-aligning electrical connector in such a manner to provide relative movement which enhances the self-aligning capability of the component.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DETAILED DESCRIPTION OF THE INVENTION

A self-aligning electrical connector device comprises a receptacle component A having a conically contoured interior and a plug component B having a correspondingly contoured conical body receivable in the receptacle component. The plug component includes a plurality of spaced conductive ring elements having a mating face and the receptacle component includes a plurality of corresponding spaced conductive ring elements providing mating interface with the mating face of the ring elements of the plug component when connected therewith. Each ring element of the receptacle component includes a plurality of segmented portions. The segmented portions deflect downwardly when the plug component is inserted therein asserting a biasing force against the face of the ring elements of the plug component providing positive electrical contact and connection between the ring elements of the components.

The device further includes fastener means for connecting at least one of the components to an associated chassis C of a space module or a vehicle which affords relative movement between the component and chassis enhancing alignment with the other component for engagement and connection therebetween.

Referring now in more detail to the drawings, an electrical connector device is illustrated which includes the receptacle component A and a plug component B. Each component is provided with a flange 10 and 12, respectively, for mechanically attaching the components to the chassis of either the vehicle or the module. The receptacle and plug components may be attached to either the module or vehicle without any preference. Normally, however, it is preferred that plug component B be mechanically attached to the vehicle chassis to reduce the likelihood of damage since the module is subject to unprotected movements.

The receptacle component A includes a plurality of conductive contact rings 14 which are uniquely constructed to have a mating surface 16 which is segmented to define a plurality of resilient segmented portions 16*a* which impart a spring-like action against the corresponding mating rings of the plug component. The segmented mating surface of ring 16 is at such an angle that the individual segmented portions 16*a* give a positive spring-loaded contact when mating is electrical connection. Consequently, when the connector parts are released for demating, this spring force expels the male component without any requirement for pulling on the connector or cable attached thereto. The risk of damage to solder joints from such action is thus avoided.

Figure 3:
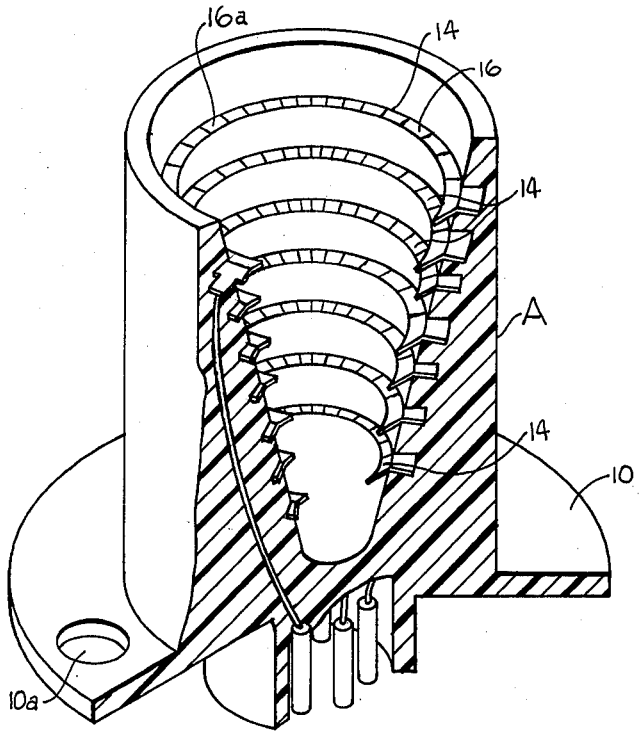
FIG. 3 is a perspective view of the receptacle component which is partially cut away to illustrate the annular contact rings and their connection in the receptacle component.
Figure 3A:
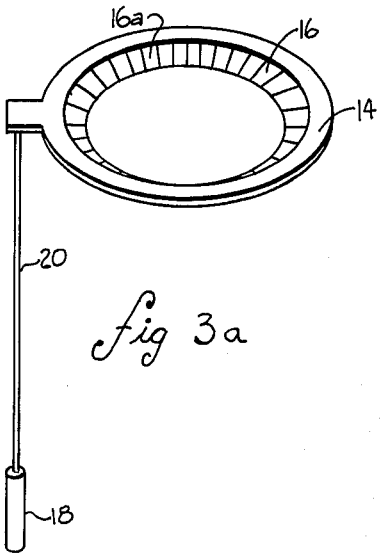
FIG. 3*a* is a perspective view of the annular mating ring of the receptacle component having segmented spring-loaded contact surfaces.
Figure 3B:
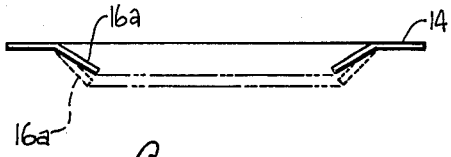
FIG. 3*b* is a sectional view of the receptacle contact ring illustrated in FIG. 3*a* illustrating the spring-loaded feature of the mating ring.

As illustrated in FIG. 3*b*, the segmented portions of contact rings 16 bend from the full line to the dotted line position when egaged by corresponding, spaced rings carried by the plug B whereby the rings are biased into electrical contact. The rings of the receptacle component are adapted for outside electrical connection such as with associated circuitry inside the module as may be utilized for experiments, power, or the other electrical requirements such as power for heaters or other miscellaneous functions carried out in the module. These connections may be had in a conventional manner such as by pins 18 connected to respective rings 14 by means of conductors 20 which may be any suitable metal wire or rod connector.

Figure 4:
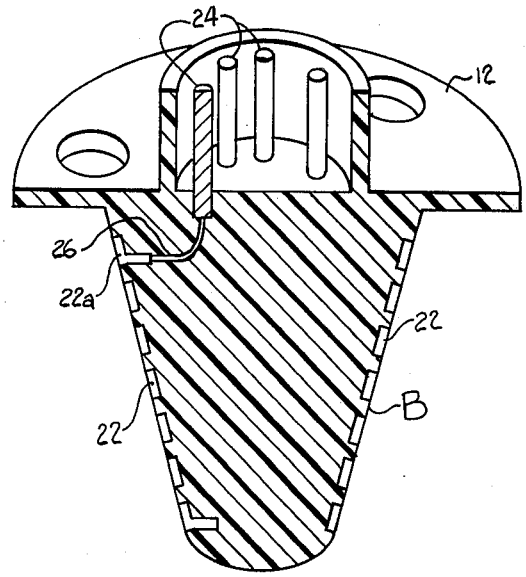
FIG. 4 is a perspective view of the plug component of the invention in section illustrating the contact rings and their connection.
Figure 4A:
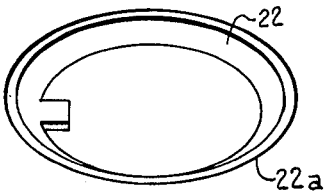
FIG. 4*a* is a perspective view of a contact ring of the plug component.

The plug component B includes a plurality of contact rings 22 having contoured surfaces 22*a* which mate with the ring faces 16*a* of the female component and may have a construction such as shown in FIG. 4*a* and may be molded in a phenolic resin material as illustrated. The rings 22 of the plug component are adapted for outside electric connection by means of pins 24 and imbedded conductors 26 so that connection to the circuitry of the space vehicle may be had by suitable wiring in a conventional manner.

Figure 1:
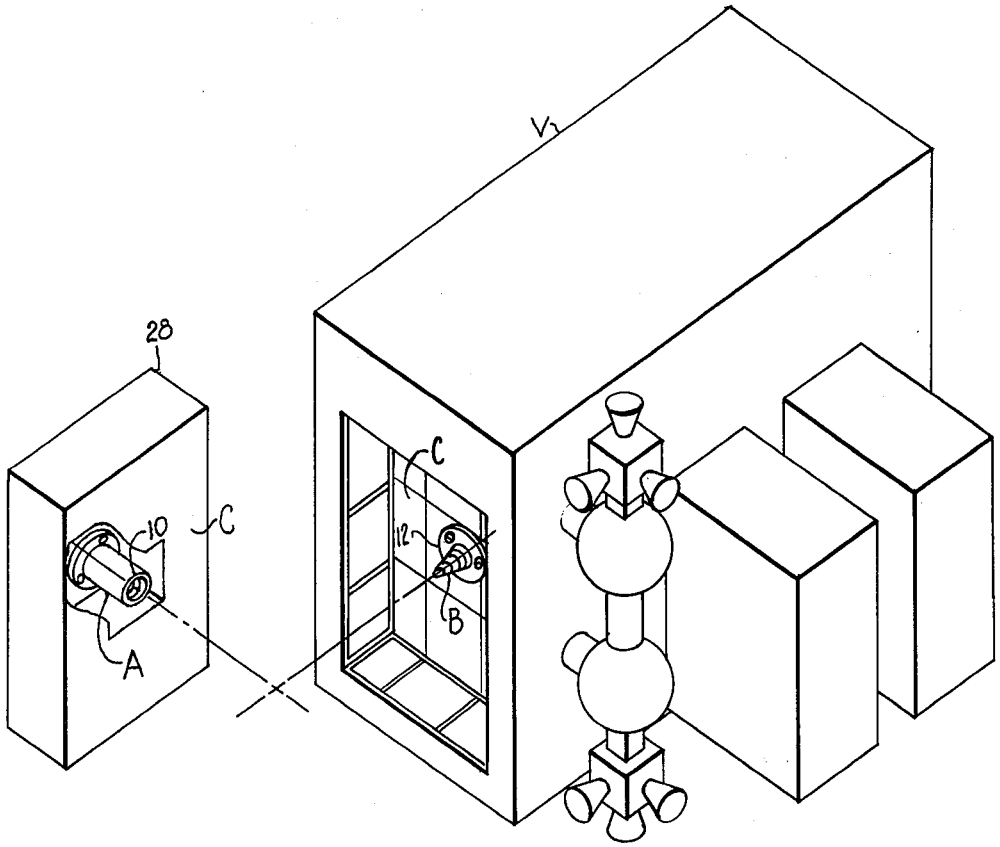
FIG. 1 is a perspective view illustrating application of the present invention to a space vehicle and removable module for making electrical connection therebetween.
Figure 2:
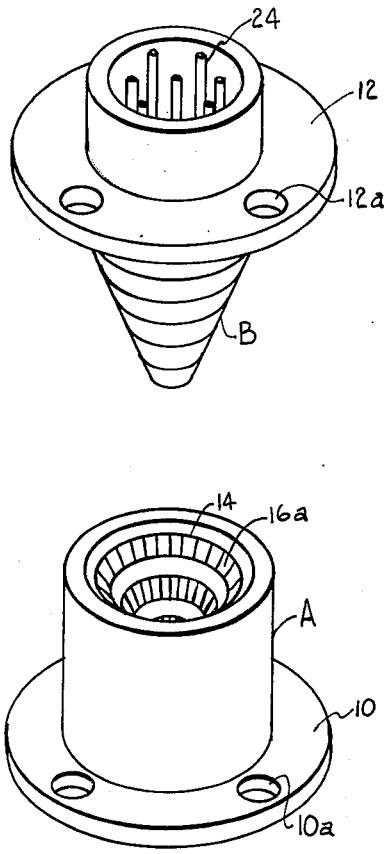
FIG. 2 is a perspective view illustrating the plug and receptacle components of the invention in a disconnected configuration.
Figure 2A:
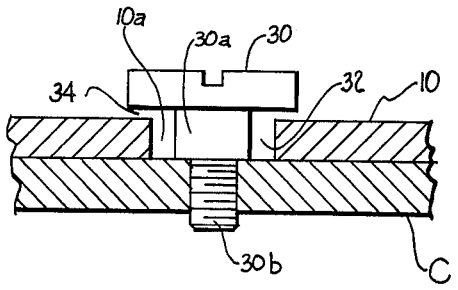
FIG. 2*a* is a partial sectional view in elevation illustrating the mechanical connection of the plug and receptacle components to their respective module or vehicle surfaces.

As illustrated in FIG. 2, receptacle A is mounted to the chassis C of module 28 of the module by means of a fastener 30 of the screw type having a non-threaded body portion 30*a* which is reduced in diameter from the opening 10*a* in flange 10 to provide a clearance space 32. Fastener 30 stops short of flange 10, due to body 30*a* being not threaded, to define a clearance space 34 therebetween. Clearance spaces 32 and 34 afford movement of receptacle A with respect to module chassis which allows receptacle A to move in two degrees of freedom and align with plug B. Similarly, plug B is attached to the vehicle chassis by such a fastener 30 affording two degrees of relative movement therebetween. This enhances the self-alignment of the connectors which is particularly helpful in utilizing ganged connectors, i.e. several connectors ganged together on the module and vehicle chassis. In such an application, the relative movements insure alignment of the several connectors.

While a preferred embodiment of the invention has been described using specific terms, such description is for illustrative purposes only and it is to be understood that changes and variations may be made without departing from the spirit or scope of the following claims.

What is claimed is:

1. A self-aligning electrical connector device comprising:

a receptacle having a conically contoured interior tapered downwardly from an open end toward a remote end of said interior;

a plug having a correspondingly conically contoured body receivable in said contoured interior of said receptacle, said plug body being tapered from one end to another in the same direction as said interior of said receptacle;

said plug including a plurality of spaced conductive ring elements adapted for electrical connection to an outside source, each said ring element of said plug having a mating conductive face around the circumference of said ring element;

said plug ring elements having progressively smaller diameters decreasing in the direction of taper of said plug body;

said receptacle including a plurality of correspondingly spaced conductive ring elements secured within said contoured interior of said receptacle component having progressively smaller diameters decreasing in the direction of taper of said contoured interior of said receptacle corresponding with the diameter of said receptacle ring elements;

each said receptacle ring element including a plurality of individual segmented portions around the circumference of said ring element;

said segmented portions of each ring element being separately deflectable downwardly in the direction of taper of said contoured interior of said receptacle;

said segmented portions of each said ring element being defined by slits so that adjacent segments of said ring are in edge-to-edge contact when said segments are in an undeflected position and form a continuously closed ring element when said ring is disengaged from said receptacle component;

said segmented portions of each said receptacle ring element having a deflected position wherein said segmented portions separate from one another and bend downwardly when said plug is inserted in said receptacle, said segmented ring element extending into said interior at such an angle that upon deflection a biasing force is asserted against said ring elements of said plug for positive electrical contact around the circumference of said ring elements; and said segment portions in said deflected position exerting an axial ejection force against said plug body in a direction opposite to said direction of taper of said plug body to urge said plug body outwardly from said receptacle when said plug and receptacle components are released for disengagement facilitating disengagement without exterior force so that said receptacle and plug may separate with reduced damage to electrical connections.

2. The apparatus of claim 1 including:

a flange carried by one of said receptacles or plug components;

an attachment opening formed in said flange;

a threaded fastener received in said attachment opening securing said component to a chassis;

said fastener including a main body reduced in its cross-sectional shape relative to the shape of said opening so that said component and attachment flange may move about said fastener relative to said chassis in rotational and translational motion; and said fastener including a widened head engaging said attachment flange to prevent movement of said attachment flange over said head;

said main body having a height greater than the height of said attachment opening whereby axial movement of said attachment flange relative to said main body portion of said fastener is permitted while retained by said head whereby said component may move in rotational, translational and axial movement for self-alignment.

* * * * *